US005194686A

United States Patent [19]

Winkler

[11] Patent Number: 5,194,686

[45] Date of Patent: Mar. 16, 1993

[54] DEVICE FOR ELECTROACOUSTIC AMPLIFICATION OF A STRINGED INSTRUMENT WITH A TAILPIECE

[76] Inventor: Klaus Winkler, Trettachstr. 6, D-8901 Stadtbergen, Fed. Rep. of Germany

[21] Appl. No.: 777,247

[22] PCT Filed: Jun. 1, 1990

[86] PCT No.: PCT/EP90/00875

§ 371 Date: Nov. 27, 1991

§ 102(e) Date: Nov. 27, 1991

[87] PCT Pub. No.: WO90/15406

PCT Pub. Date: Dec. 13, 1990

[30] Foreign Application Priority Data

Jun. 1, 1989 [DE] Fed. Rep. of Germany ..... 3917912
Jun. 26, 1989 [DE] Fed. Rep. of Germany ..... 3920865

[51] Int. Cl.[5] ..... C10H 3/00; C10H 1/32

[52] U.S. Cl. ..... 84/743

[58] Field of Search ..... 84/743, 730, 731, 734

[56] References Cited

U.S. PATENT DOCUMENTS

| | | | |
|---|---|---|---|
| 3,935,782 | 2/1976 | O'Brien | 85/1.16 |
| 4,351,217 | 9/1982 | Wechter | 84/329 X |
| 4,570,522 | 2/1986 | May | 84/1.14 |
| 4,843,937 | 7/1989 | Murphy | 84/1.16 |
| 4,941,389 | 7/1990 | Wendler | 84/743 X |
| 4,995,293 | 2/1991 | Anderson | 84/743 X |
| 5,010,803 | 4/1991 | Donnell | 84/743 |

FOREIGN PATENT DOCUMENTS

| | | |
|---|---|---|
| 0966106 | 7/1957 | Fed. Rep. of Germany . |
| 0671110 | 7/1989 | Switzerland . |

*Primary Examiner*—William M. Shoop, Jr.
*Assistant Examiner*—Jeffrey W. Donels
*Attorney, Agent, or Firm*—Kenyon & Kenyon

[57] ABSTRACT

A device for electroacoustically amplifying a stringed instrument features a hollow tailpiece button (1), which supports a microphone (3) arranged inside the body of a stringed instrument (10).

11 Claims, 2 Drawing Sheets

DEVICE FOR ELECTROACOUSTIC AMPLIFICATION OF A STRINGED INSTRUMENT WITH A TAILPIECE

BACKGROUND OF THE INVENTION

The invention relates to a device for electroacoustically amplifying a stringed instrument with a tailpiece button and with a sound pick-up device attached to the stringed instrument by means of a mounting support, whereby the sound pick-up device is suitable for connection to an amplifier via lead wires that run through the hollow formed tailpiece button.

Up until now, to facilitate the direct electroacoustic amplification of a violin, for example, a microphone had to be provisionally attached to the tailpiece in the vicinity of the violin's bridge. Occasionally, could achieve the desired electroacoustic sound amplification for stringed instruments using such customary clip-on microphones. This type of direct sound amplification is sometimes necessary, particularly to promote studio effects or for concerts held under unfavorable acoustical conditions, such as open-air concerts.

However, the danger with this known device is that during intensely moving play, the configuration can be touched or even pushed off. Moreover, the tonal result is unsatisfactory since outside influences such as noises from the bow or the musician's breath can also be amplified to an undesired degree. In addition, the device represents an unwanted foreign body, which— besides the fact that it is optically disturbing —can inhibit the musician in his artistic development.

A device which avoids the previously mentioned disadvantages is known from the German Patent 966 106. A hollow tailpiece button for a stringed instrument is described therein, through which lead wires run to a sound pick-up device. This publication makes no mention of where this sound pick-up device has to be mounted in or on the stringed instrument nor of the means required to attach this device there. However, even the question of the mounting support is a problem that needs be optimally solved in order not to interfere with the acoustic pattern of the stringed instrument.

Therefore, the object of the invention is to further develop the known device in a way which will allow the sound pick-up device to be attached in an extremely simple way to a stringed instrument. Another object consists in specifying a device which can be removed again from the stringed instrument with only little manipulation.

SUMMARY OF THE INVENTION

This object is solved in that the sound pick-up device is a microphone, and that this microphone is arranged inside the body of the stringed instrument and is supported by the hollow tailpiece button.

Further developments of the invention constitute the subject matter of the dependent claims.

The invention takes advantage in particular of the fact that a tailpiece button is provided anyway in stringed instruments. This tailpiece button is used in stringed instruments to attach the tailpiece cord. Based on this realization, the invention proposes replacing this customary tailpiece button with a hollow tailpiece button, which serves at the same time as a mounting support for a microphone to be introduced inside the body of the stringed instrument. The microphone arranged in the hollow tailpiece button can be removed at any time, and the then remaining hollow space can be replaced by a dummy plug, for example.

Important advantages of the device according to the invention lie in that 1) the quality of the amplification is improved due to the higher sonic pressure inside the stringed instrument;
2) the characteristic sound of the stringed instrument is optimally heard to its best advantage;
3) external noise influences are largely eliminated due to the arrangement of the microphone inside the body of the stringed instrument;
4) the unwanted electroacoustic feedback is avoided;
5) at the same time, the microphone is arranged so that is optimally protected in the stringed instrument;
6) with the exception of the cable connection which is conditional upon the system, in other words the electrical lead wire running to the amplifier, the player is no longer impeded.

The invention shall be clarified in the following on the basis of an exemplified embodiment in connection with three Figures for application in a violin. However, the invention is not restricted to violins. On the contrary, the invention can be applied to all types of stringed instruments, which in any case already have a tailpiece button. In a cello, for example, this is an endpin.

DETAILED DESCRIPTION

Figure 1:
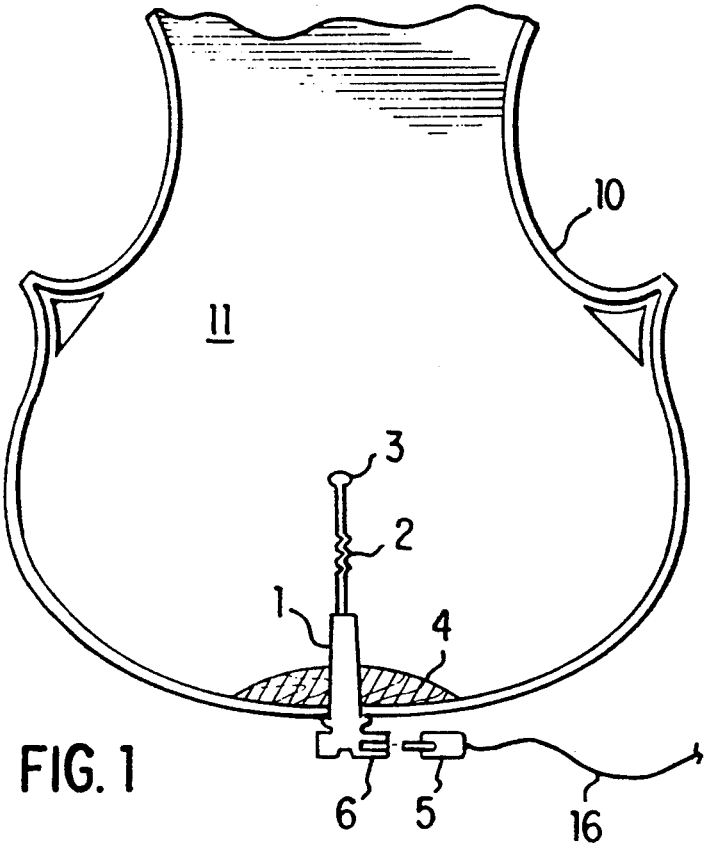
FIG. 1 a first exemplified embodiment of a device according to the invention in a top view of the body of a violin which is open to the top.

A first exemplified embodiment of a device according to the invention is depicted in FIG. 1 in the top view of the body 10 of a violin open to the top. The tailpiece button that is provided in any case on each violin is now replaced by a mounting support, which is designed as a hollow tailpiece button 1. This conically tapered inner part of the tailpiece button fits in this example in the shaft of the block 4 which is customary in violins. A microphone 3 is held by the hollow tailpiece button 1, preferably by way of a flexible attachment 2. The microphone 3 is arranged thereby inside the body of the violin 11. A detachable connection is preferably provided at the end of the hollow tailpiece button situated opposite the microphone 3. By means of this detachable connection, lead wires 16 running to the amplifier are able to be connected to the microphone. In this exemplified embodiment, the detachable connection is configured as a plug connector 5 and socket 6 designed at one end of the lead wires 16 and mounted on the end of the hollow tailpiece button opposing the microphone 3. The plug connector 5 and socket 6 preferably exhibit a bayonet lock.

Figure 2:
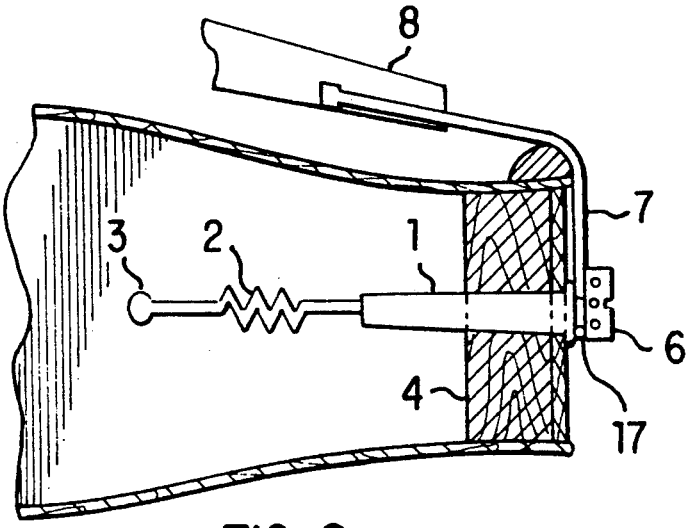
FIG. 2 a side view of the device according to the invention in an installed state.

FIG. 2 depicts the side view of the device according to the invention belonging to FIG. 1. The already known reference symbols are still used for the same parts. Since, according to the invention, the hollow tailpiece button 1 has the dimensions of the tailpiece button used anyway in violins, on can easily attach the tailpiece cord 7 coming from the tailpiece 8 to the hollow tailpiece button 1. For this purpose, the hollow tailpiece button 1, in the same way as the tailpiece button that is customary in any case, exhibits an annular recess 17, around which the tailpiece cord 7 is wrapped to secure the tailpiece. The hollow tailpiece button 1 is clamped in the shaft of the block 4.

Figure 3A:
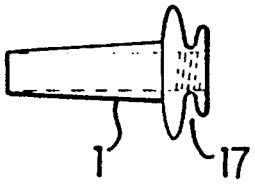
FIGS. 3(*a*)–3(*c*) possible specific embodiments for a hollow tailpiece button, a dummy plug and a microphone plug with a microphone.
Figure 3B:
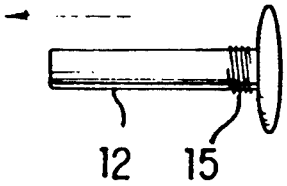
Figure 3C:
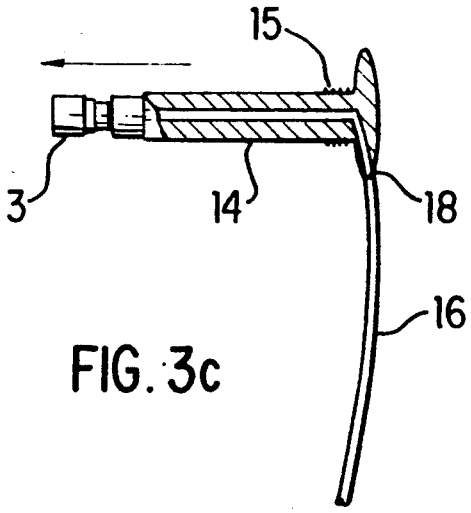

A particularly preferred specific embodiment of the hollow tailpiece button 1 is shown in FIG. 3. This hollow tailpiece button 1 now likewise exhibits the dimensions of a tailpiece button existing anyway in violins. The hollow tialpiece button 1 has a cylindrical opening, now additionally with an internal screw thread, into which the dummy plug 12 shown in FIG. 3*b* or the microphone plug 14 shown in FIG. 3*c*, together with the microphone 3, can be screwed into place. The dummy plug 12 is suited for being screwed into the hollow tailpiece button 1. For this, the dummy plug 12 features an external thread 15. This dummy plug 12 is screwed into the hollow tailpiece button 1, when no electroacoustic amplification of the violin is to take place.

In FIG. 3*c*, on the other hand, the already described microphone 3 is now shown mounted in a microphone plug 14. The microphone plug 14 is resembles the dummy plug 12 and is likewise provided with an external thread 15. The microphone 3 is suitable for connection via a lead wire 16 to an electrical amplifier. The lead wire 16 runs via an opening 18 through the microphone plug 14 to the microphone 3. If the tones of the violin are supposed to be electroacoustically amplified, this microphone plug 14 is screwed together with the microphone 3 into the hollow tailpiece button 1. The microphone 3 is thus situated inside the body of the stringed instrument.

Instead of a screw connection between the hollow tailpiece button and the dummy plug !2 or rather the microphone plug 14, a clamped joint can likewise be provided. The hollow tailpiece button 1, the dummy plug 12 and the microphone plug 14 are preferably formed from aluminum and, in particular, black-anodized.

The construction of the hollow tailpiece button 1, the dummy plug 12 and the microphone plug 14 depicted in FIG. 3 makes it possible for the hollow tailpiece button 1 to be installed in the stringed instrument once. This hollow tailpiece button 1 can then always remain in the stringed instrument. The microphone 3 is supported by a microphone plug 14 similar to the dummy plug 12. The only difference that remains in the installation of this microphone plug 14 in the hollow tailpiece button 1 compared to the tailpiece buttons found anyway in stringed instruments is the lead wire 16 running to the electrical amplifier. When no amplification is desired, the opening in the hollow tailpiece button 1 can then be sealed by means of the dummy plug 12, so that this new hollow tailpiece button 1 does not differ from a conventional tailpiece button.

The important advantages of such a design of the hollow tailpiece button 1, the dummy plug 12 and the microphone plug 14 consist in that each stringed instrument must only be reequipped one single time, the microphone 3 can be installed and removed very quickly, and different types of microphones can be used at any time.

In conclusion, reference is also made to the fact that a microphone, which can support itself in the hollow tailpiece button 1, can also be used of course in place of the microphone plug 14. For this purpose, the microphone itself is effectively provided with an external thread and black anodized. In place of a screw connection, a clamped joint can also be provided.

It turns out that an optimum sound result is achieved when the microphone is supported 3 - 10 mm, preferably 5 mm from the end of the hollow tailpiece button.

A transmitting unit can also be used as an amplifier for wireless transmission.

This system is generally applicable to all stringed instruments that come equipped with a tailpiece button or that can be equipped with such a tailpiece button.

What is claimed is:

1. A device for electoracoustically amplifying a stringed instrument, comprising:

a hollow tailpiece button;

a mounting support; and a microphone for attachment to a stringed instrument by means of the mounting support, said microphone including lead wires to enable the connection of the microphone with an amplifier via lead wires that run through the hollow tailpiece button, said microphone operating as a sound pick-up device with respect to the stringed instrument;

wherein the microphone is arranged to be supported by the hollow tailpiece button inside the body of the stringed instrument and is configured to be easily removed from the stringed instrument by the translation of the microphone through the hollow tailpiece button from the interior of the stringed instrument to the exterior of the stringed instrument.

2. The device according to claim 1, wherein the hollow tailpiece button is provided with an internal screw thread, into which the microphone can be screwed into place.

3. The device according to claim 2, wherein the device includes a microphone plug having an external thread, and the microphone is mounted in the microphone plug, and the microphone plug can be screwed together with the microphone into the hollow tailpiece button.

4. The device according to claim 1, wherein the microphone can be clamped into the hollow tailpiece button.

5. The device according to claim 4, wherein the microphone is mounted in the microphone plug and the microphone plug can be clamped together with the microphone into the hollow tailpiece button.

6. The device according to claim 1, further comprising a dummy plug which can be supported in place of the microphone in the hollow tailpiece button when no electrical amplification is provided.

7. The device according to claim 1, wherein the microphone is connected via a detachable connection to lead wires running to an amplifier.

8. The device according to claim 7, wherein the detachable connection is designed with a bayonet lock.

9. The device according to claim 6, wherein the hollow tailpiece button and the dummy plug are formed from aluminum and, in particular, black-anodized aluminum.

10. The device according to one claim 1, wherein the stringed instrument is one of the group consisting of a violin, viola, cello, and double bass.

11. The device according to claim 6, wherein the hollow tailpiece button containing the dummy plug has the outer dimensions and the shape of a pre-existing tailpiece button of the stringed instrument, thereby enabling one to replace the pre-existing tailpiece button with said hollow tailpiece button.

* * * * *